US007784517B2

(12) United States Patent
Sakanishi

(10) Patent No.: US 7,784,517 B2
(45) Date of Patent: Aug. 31, 2010

(54) COATING FILM TRANSFER TOOL

(75) Inventor: Yutaka Sakanishi, Osaka (JP)

(73) Assignee: Fujicopian Co., Ltd., Osaka (JP)

( * ) Notice: Subject to any disclaimer, the term of this patent is extended or adjusted under 35 U.S.C. 154(b) by 131 days.

(21) Appl. No.: 12/223,561

(22) PCT Filed: Jan. 24, 2007

(86) PCT No.: PCT/JP2007/051537

§ 371 (c)(1),
(2), (4) Date: Aug. 1, 2008

(87) PCT Pub. No.: WO2007/091454

PCT Pub. Date: Aug. 16, 2007

(65) Prior Publication Data

US 2009/0050275 A1 Feb. 26, 2009

(30) Foreign Application Priority Data

Feb. 6, 2006 (JP) ..... 2006-028117

(51) Int. Cl.
*B65H 37/00* (2006.01)

(52) U.S. Cl. ..... 156/540; 156/538; 156/230

(58) Field of Classification Search ..... 156/523, 156/577, 344, 540, 579, 538, 230
See application file for complete search history.

(56) References Cited

U.S. PATENT DOCUMENTS

| | | | | |
|---|---|---|---|---|
| 3,889,310 | A * | 6/1975 | Barouh et al. | 15/210.1 |
| 5,316,613 | A * | 5/1994 | Samuelson et al. | 156/540 |
| 6,062,286 | A * | 5/2000 | Koyama et al. | 156/540 |

FOREIGN PATENT DOCUMENTS

| | | | |
|---|---|---|---|
| JP | 06-055895 | A | 3/1994 |
| JP | 11-227386 | A | 8/1999 |
| JP | 2002-264588 | A | 9/2002 |

* cited by examiner

*Primary Examiner*—Kat Wyrozebski
*Assistant Examiner*—Vishal I Patel
(74) *Attorney, Agent, or Firm*—Howson & Howson LLP

(57) ABSTRACT

In a coating film transfer tool having a supply reel a transfer head, a take-up reel mounted in a main casing, and a ratchet gear on one of the reels, a sliding body, which is slidable relative to the main casing, has a cover with an opening through which the transfer head can protrude for spot transfer, and a pawl arranged to drive the ratchet gear in a direction to feed tape past the transfer head when the main casing moves relative to the sliding body in a direction such that the transfer head is withdrawn to a protected position within the cover. The cover is movable to an open position for continuous transfer.

2 Claims, 7 Drawing Sheets

COATING FILM TRANSFER TOOL

FIELD OF THE INVENTION

This invention relates to a coating film transfer tool for transferring films such as correction films and adhesives onto a receiving surface.

BACKGROUND ART

A conventional coating film transfer tools comprises a supply reel and a take-up reel, both rotatably supported within a case having a transfer head, the supply reel having therearound a roll of a transfer film which is composed of a base tape and a coating film attached thereon. The transfer head is pressed against and moved parallel to a receiving surface to transfer the coating film thereon.

A relatively long section of print with 10-15 letters can be easily erased with such a coating film transfer tool. However, when erasing a small section with one or a few letters, it is hard to adjust the length of the transfer tape to just cover the letter(s) to be erased, often transferring the film over or short of the part to be erased. In such a case, coating films have to be removed or added, requiring extra time in erasing letters as intended.

In light of this problem, Unexamined Japanese Patent Publications No. 55895/1994 and No. 227386/1999 disclose stamp-type coating film transfer tools, in which a transfer head is vertically pressed against a receiving surface to transfer a coating film on a spot. Transfer tools of this type comprise a slider which is held within a case so as to be movable therein, a transfer head at the end of the slider, and the transfer tool is pressed against a receiving surface to transfer a coating film. Further, it has a ratchet which moves with the slider and engages with a gear formed on a take-up reel so as to constantly reel out a specific amount of an unused transfer tape. Since the size (width) of the head equals a range of the coating film to be transferred in these pressing-type transfer tools, the coating film can be unfailingly transferred on an intended spot.

DISCLOSURE OF THE INVENTION

However, a first embodiment disclosed in Unexamined Japanese Patent Publication No. 55895/1994 lacks user-friendliness, because it requires a user to keep holding down a button which stands out of a rear end of a cylindrical case. A second embodiment, in which a pressing stick is made projected from the case to transfer the coating film as the slider is pressed back into the case, is hard to be moved parallel to the receiving surface for continuous transfer of the film. Further, since a spring which holds the slider is not arranged coaxially with the pressing stick or on a midline of the slider, the pressing stick cannot be moved into and out of the case smoothly, causing a problem in handling.

According to the invention disclosed in the publication No. 227386/1999, the transfer tool can be used both as a stamp-type tool to be pressed down against a receiving surface and as a conventional transfer tool to be moved parallel to the surface. However, it is not capable of smooth continuous transfer, because the transfer head has a generally flat surface. In addition, it leaves following problems in handling; the head member cannot be pressed hard against a receiving surface, because it is supported by elastic force of a spring; the head member is kept exposed, letting the coating film fall off and thus requiring a user to turn a reel to unreel an unused transfer tape before using the tool.

In view of the above problems, the object of the present invention is to provide a coating film transfer tool which is capable of both way of unfailing transfer, spotting transfer by pressing and continuous transfer by pressing and parallel shifting, and which is capable of easy switchover between the two functions.

The present invention solved the above-mentioned problems with a coating film transfer tool comprising a supply reel which supplies a transfer tape composed of a base tape and a coating film attached thereon, a transfer head which is pressed against a receiving surface to transfer said coating film thereon, a take-up reel which rolls up the base tape after transfer, and a cooperative drive mechanism which is adapted to cause said reels to rotate cooperatively, all of which are encased in a casing main body:

characterized in that a gear is coaxially provided on said supply reel or take-up reel;

a sliding body which comprises a pawl member which engages with said gear in only one direction and a cover member which houses said transfer head and has an opening is held movable by means of an elastic member within said casing main body;

said cover member being openable and closable on said sliding body;

with said cover member in a closed position, said coating film can be transferred on a spot by pressing said cover member against the receiving surface to cause said sliding body to retreat and by pressing said transfer head pushed out of the opening of said cover member against the receiving surface, and as said cover member is released from pressing and said sliding body is moved forward, said supply reel and said take-up reel can be rotated by said pawl member in a forwarding direction of said transfer tape; and with said cover member in an open position, said coating film can be transferred continuously by pressing said transfer head against and moving it parallel to the receiving surface.

Preferably, said casing main body is provided with a stopper, which is to lock said cover member in an open position.

According to this invention, with the cover member of the sliding body in a closed position, the cover member is pressed against the receiving surface, causing the sliding body to retreat and pushing the transfer head out of the opening of the cover member, which is pressed against the receiving surface. Thus, the coating film transfer tool of the present invention is capable of transferring a coating film on a spot unfailingly.

With the cover member of the sliding body in an open position, on the other hand, the coating film transfer tool is capable of unfailingly transferring the coating film to cover a wide range on the receiving surface when used in a usual manner to press the transfer head against and moving it parallel to the receiving surface.

Further, according to this invention, the coating film transfer tool has improved handleability, because it is capable of switchover between spotting transfer by pressing and continuous transfer by pressing and parallel shifting with a simple operation of opening and closing the cover member of the sliding body.

PREFERRED EMBODIMENTS OF THE INVENTION

Figure 1:
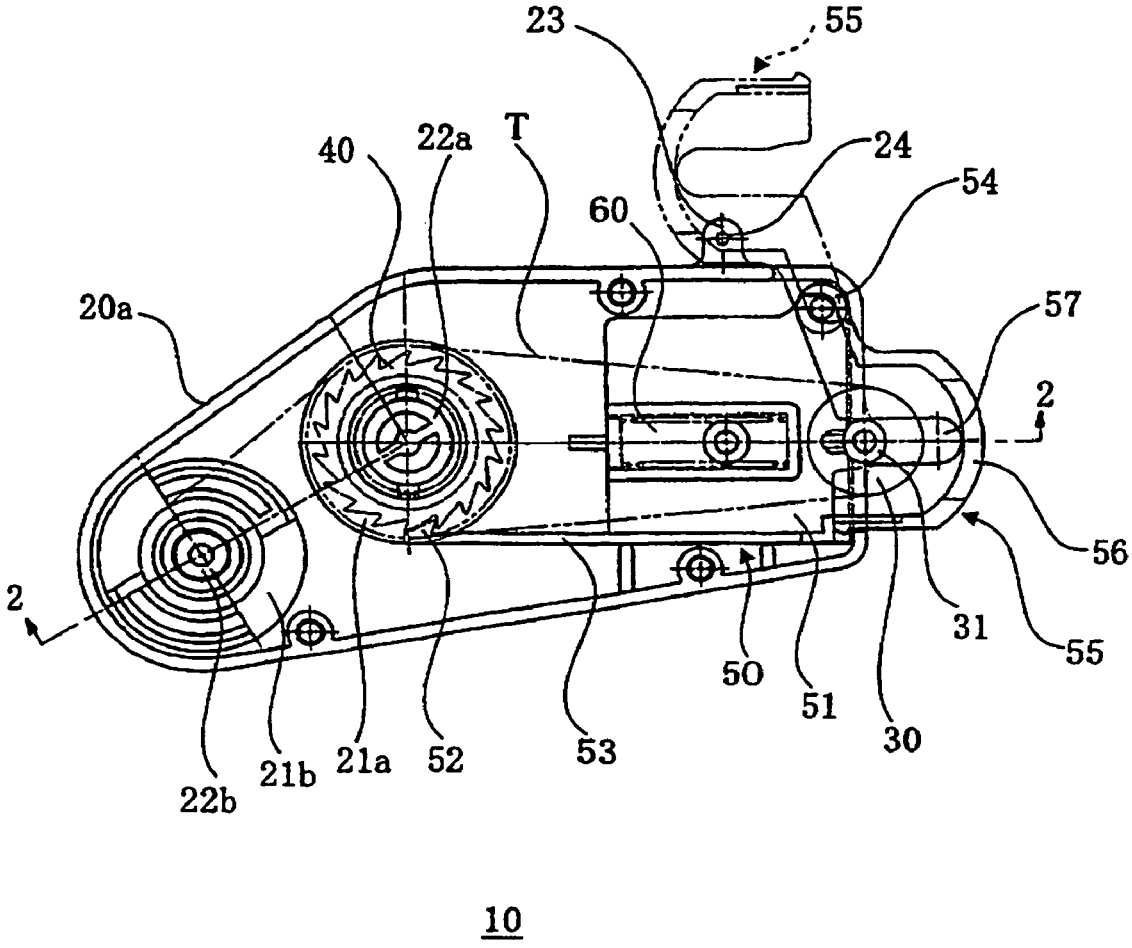
FIG. 1 is a top view of an embodiment of the coating film transfer tool of the present invention without a cover.

Referring to the drawings, an embodiment of this invention is to be described hereafter.

Figure 2:
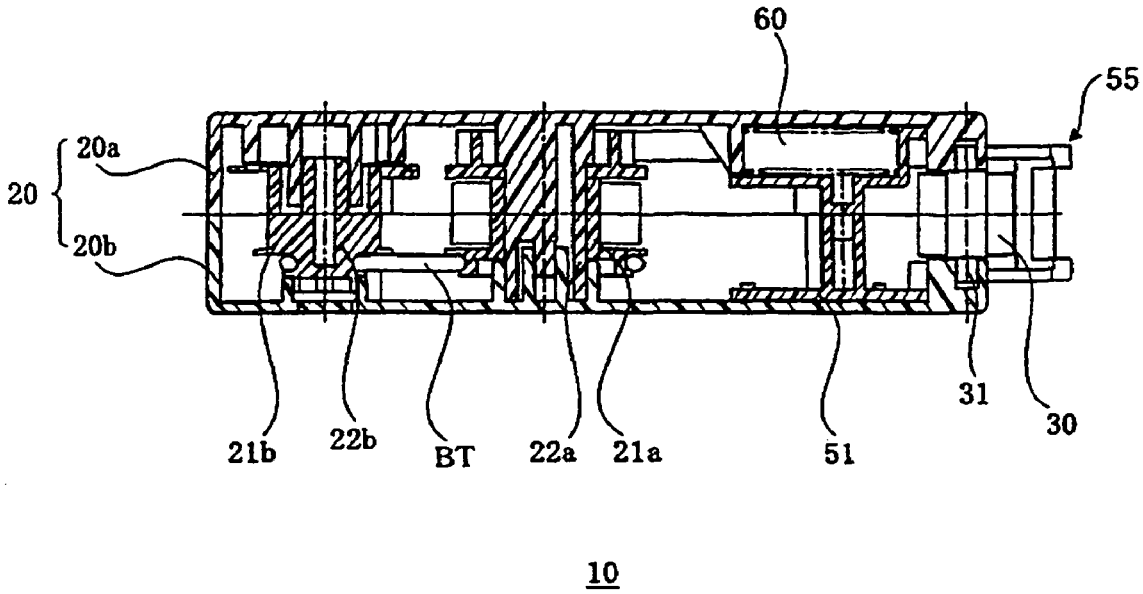
FIG. 2 is a sectional view of FIG. 1 along the line 2-2.
Figure 3:
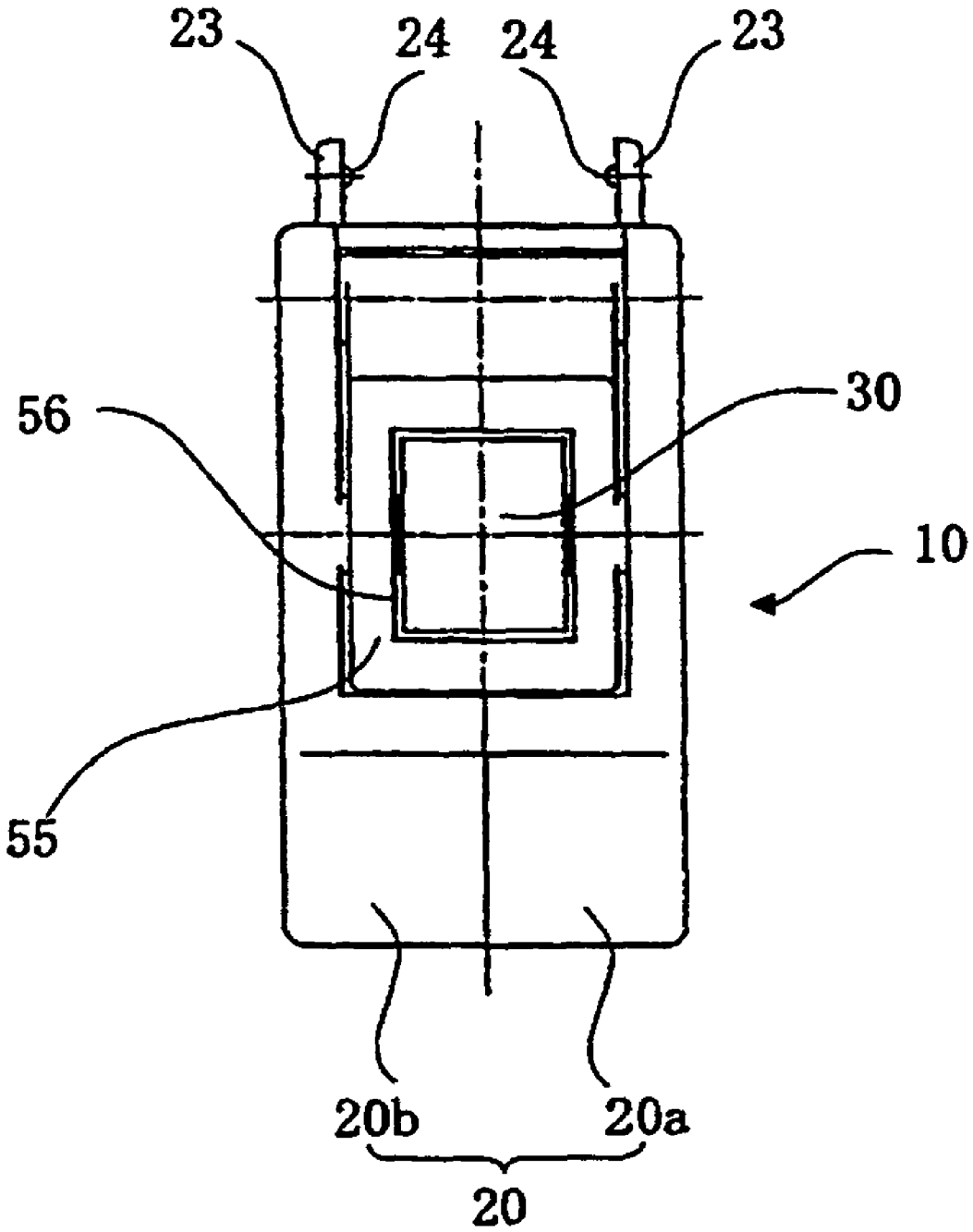
FIG. 3 is a right side view of FIG. 1.
Figure 4:
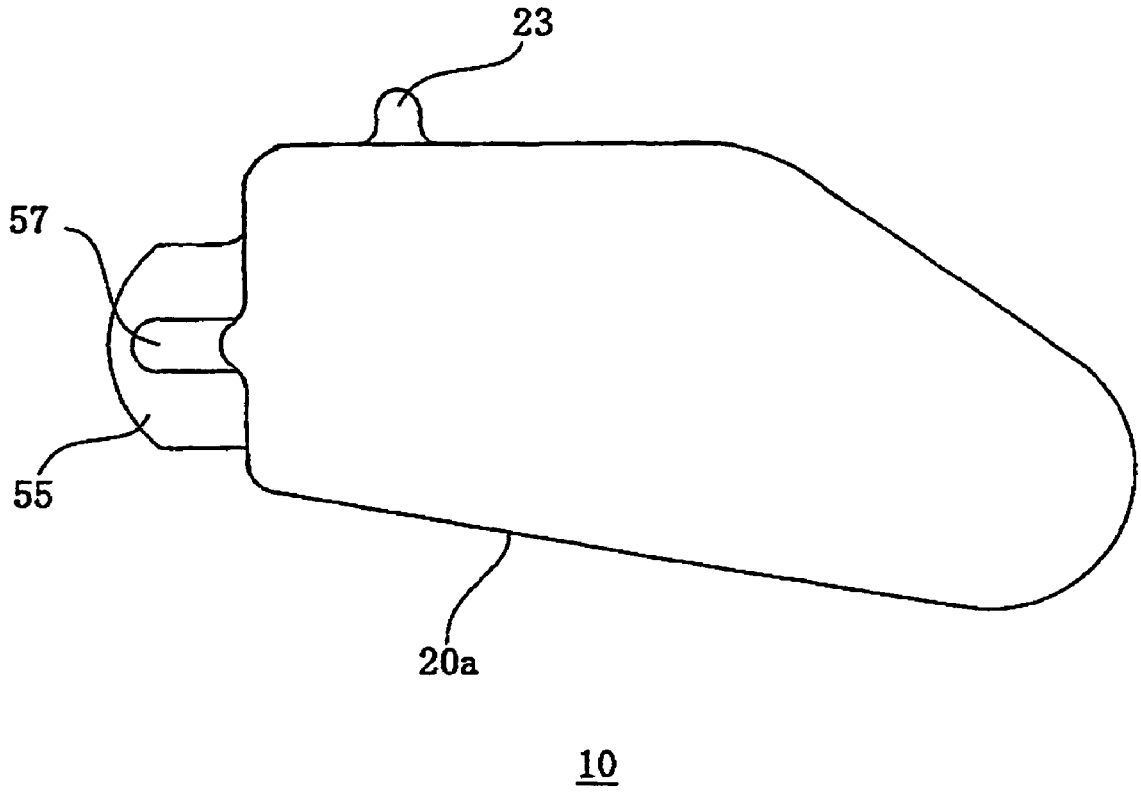
FIG. 4 is an opposite side view of FIG. 1.

FIG. 1 illustrates an embodiment of the coating film transfer tool of this invention, which is a top view of the embodiment without a cover 20*b*. FIG. 2 is a sectional view of FIG. 1 along the line 2-2. FIG. 3 is a right side view of FIG. 1, and FIG. 4 is an opposite side view of FIG. 1.

Figure 5:
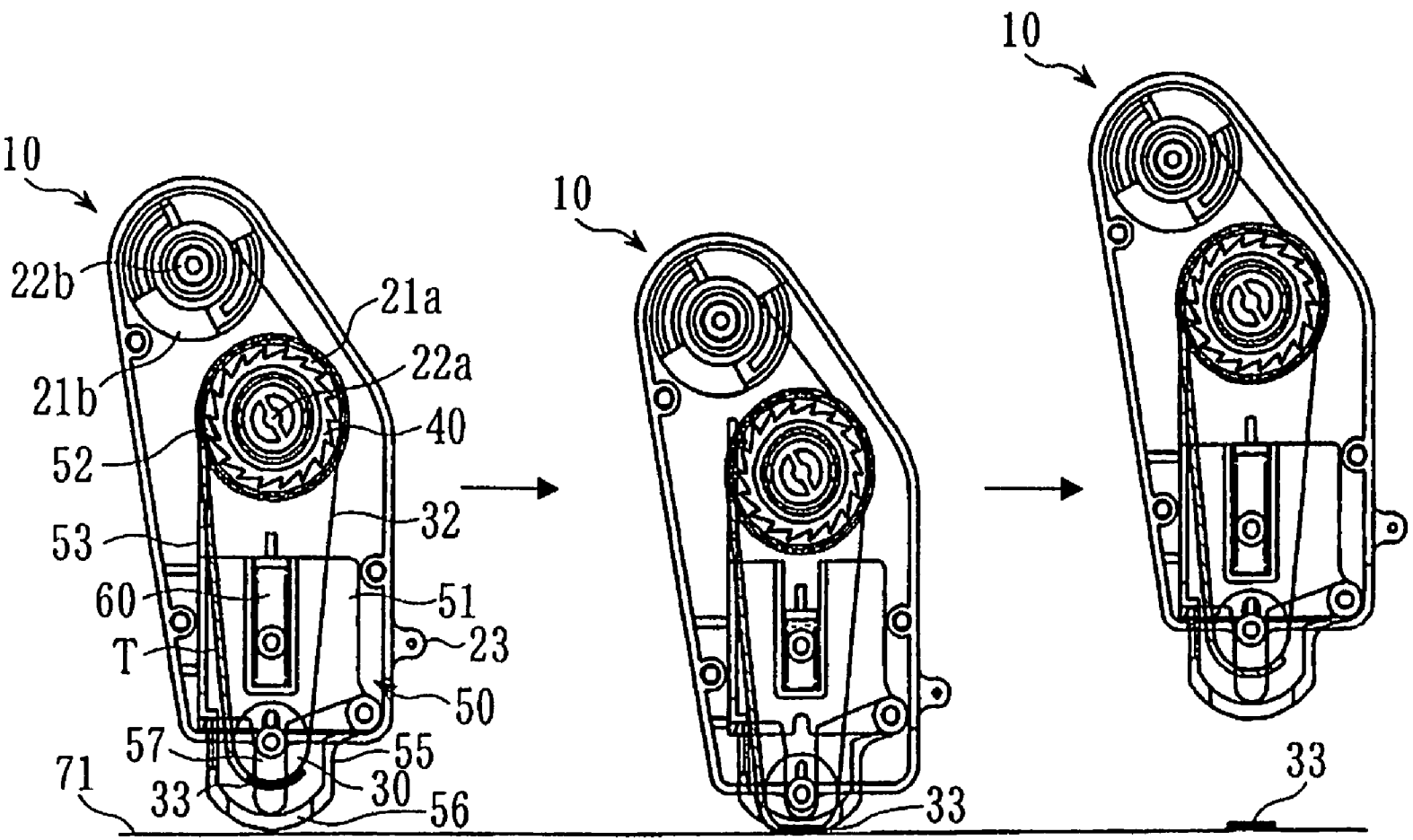
FIG. 5 illustrates the coating film transfer tool being used for spotting transfer.
Figure 6:
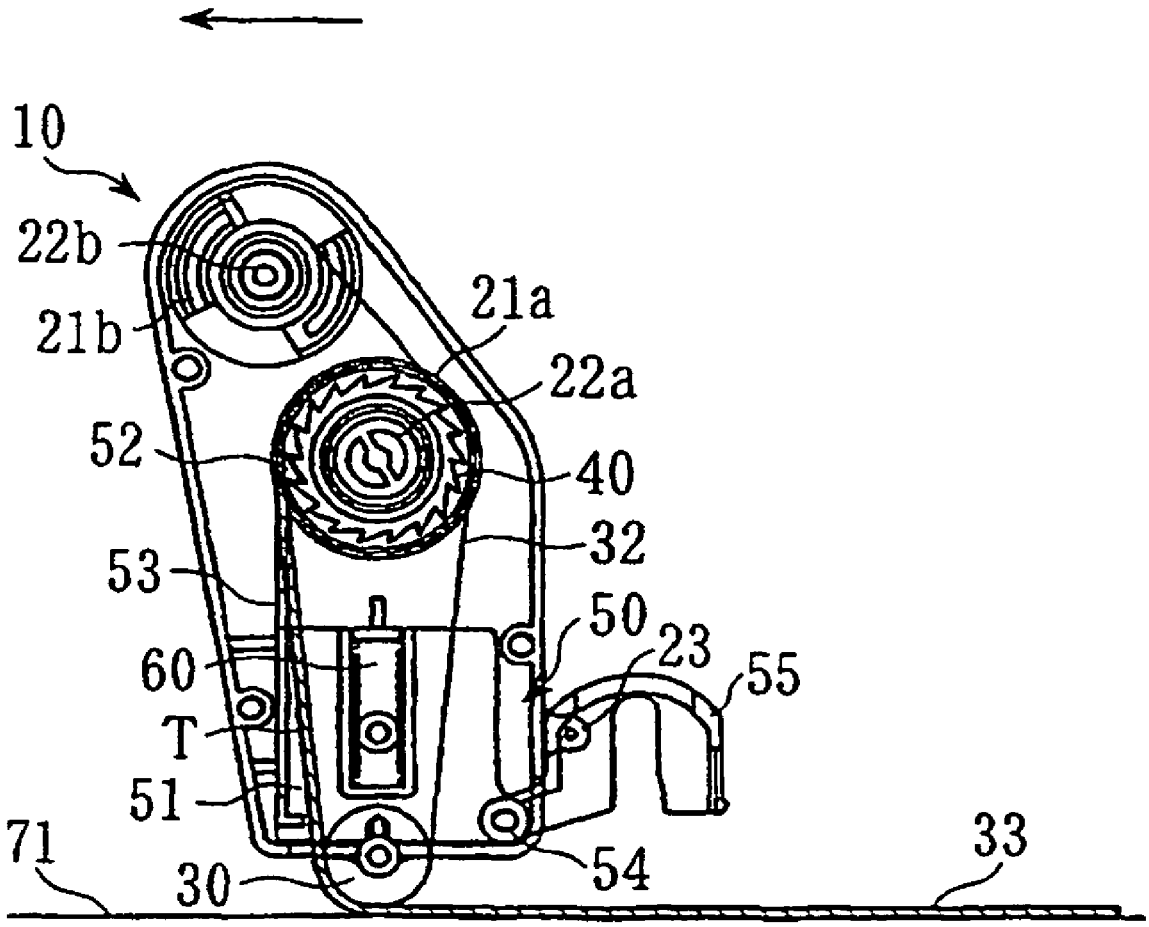
FIG. 6 illustrates the coating film transfer tool being used for continuous transfer.
Figure 7:
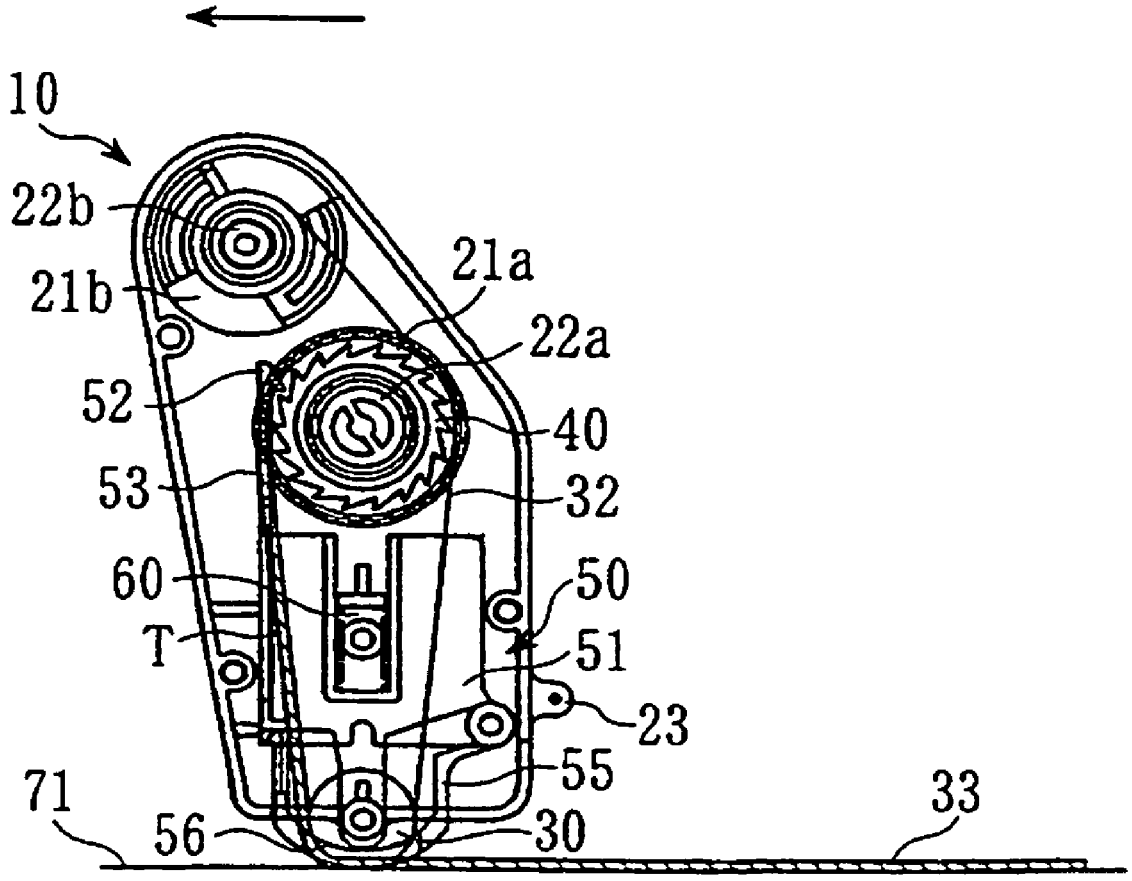
FIG. 7 illustrates the coating film transfer tool being used for continuous transfer.

FIG. 5 illustrates the embodiment being used for spotting transfer, while FIGS. 6 and 7 illustrate the same being used for continuous transfer. For illustrative purpose, FIGS. 5-7 show a casing main body of a coating film transfer tool 10 without the cover 20*b*.

The coating film transfer tool 10 of the present invention comprises a casing main body 20 composed of a case 20*a* and the cover 20*b*, a supply reel 21*a* which supplies a transfer tape T composed of a base tape and a coating film attached thereon, a transfer head 30 which is arranged at the end of the casing main body 20 and transfers the coating film onto a receiving surface as pressed against the surface, a take-up reel 21*b* which rolls up the base tape after transfer, a gear 40 which is provided coaxially on the supply reel 21*a*, a sliding member 50 having a pawl member 52 which engages with the gear 40 in only one direction and a cover member 55 which houses and protects the transfer head 30, and an elastic member 60 which holds the sliding member 50 to be movable within the casing main body 20.

This embodiment employs a pressure-sensitive adhesive film as the coating film, and a roller as the transfer head 30, both of which are but one example.

As shown in FIGS. 1 and 2, the supply reel 21*a* and the take-up reel 21*b* is rotatably supported by spindles 22*a* and 22*b* formed within the casing main body 20.

The supply reel 21*a* and the take-up reel 21*b* rotate in conjunction with each other by means of an endless rubber belt BT (a belt-type cooperative drive mechanism), so that the transfer tape T wound on the supply reel 21*a* is unreeled. The coating film is transferred onto a receiving surface as the transfer head 30 is pressed down against the receiving surface. The used base tape which passed over the transfer head 30 contacts and attaches briefly with the coating film (adhesive film) of the transfer tape T wound on the supply reel 21*a*, and then is rolled up by the take-up reel 21*b*.

The sliding body 50 comprises a sliding main body 51, the pawl member 52 which engages with the gear 40 only in the feed direction of the transfer tape T, an arm 53 which supports the pawl member 52, and the cover member 55 to protect the transfer head 30. The sliding body 50 is forward biased within the casing main body 20 by the elastic member 60 such as a coil spring, and held movable in a longitudinal direction of the casing main body 20.

A groove 57 of the cover member 55 is for guiding a shaft 31 of the transfer head when the sliding member 50 is moved back and forth.

In this embodiment, the sliding main body 51, the pawl member 52, and the arm 53 are formed integrally and are illustrated as one component. However, they need not be one component and can be formed separately, with the only condition that the pawl member 52 works in conjunction with the sliding body 50.

As illustrated in FIG. 1, the cover member 55 is made openable and closable on the sliding main body 51, supported by a joint 54. And as described hereafter, opening and closing of the cover member 55 enable switchover between spotting transfer and continuous transfer.

Firstly, as shown in full line in FIG. 1 and as illustrated in FIG. 5, when the cover member 55 is in a closed position, the transfer tool is for spotting transfer. In FIG. 5, the blacked part of the coating film 33 represents a portion to be transferred per pressing.

Referring to FIG. 5, as the cover member 55, in a closed position, is pressed substantially orthogonally against the receiving surface, the sliding body 50 is moved backward against elastic force of the elastic member 60. Then the transfer head 30, pushed out from an opening 56 of the cover member 55, is pressed against the receiving surface 71, and the coating film 33 is detached from the base tape 32 and transferred onto the receiving surface 71. During this process, the pawl member 52 which moves with the sliding body 50 is in a forward direction, and hence not in engagement, with the gear 40. Accordingly, the pawl member 52 is moved backward together with the retreating sliding body 50, past the gear 40.

When the transfer tool is released from pressing, the sliding body 50 is moved forward due to elastic force of the elastic member 60 to house the transfer head 30 therein. In this process, the pawl member 52 which moves with the sliding body 50 moves in an inverse direction to and hence engages with the gear 40. Consequently, the supply reel 21*a* rotates by predefined degrees as the pawl member 52 is moved forward, thereby supplying a predefined length of an unused transfer tape T.

On the other hand, for the standard usage, or continuous transfer, the coating film transfer tool 10 is used with the cover member 55 open, as is shown in an imaginary line in FIG. 1 and as illustrated in FIG. 6.

Referring to FIG. 6, when the cover member 55 is open, the transfer head 30 is being placed out of the casing main body 20. Accordingly, the coating film can be smoothly and continuously transferred by using the transfer tool in the usual manner; by pressing the transfer head 30 against and moving it parallel to the receiving surface 71. Since the sliding body 50 is not moved back and forth when the cover member 55 is open, the pawl member 42 does not engage with the gear 40.

As illustrated in FIGS. 1 and 6, the casing main body 20 can be provided with a stopper 23 for locking the cover member 55 in an open position.

When the cover member 55 is turned around the joint 54 on the sliding main body 51, the stopper 23, due to its elastic deformation with a projection 24 in-between, locks the cover member 55. As a result, the sliding main body 51 and the cover member 55 are securely interlocked during continuous transfer, thereby improving handleability.

The present embodiment can also be used for continuous transfer with the cover member 55 in a closed position. More specifically, as the cover member 55 is pressed substantially orthogonally against the receiving surface 71, the sliding body 50 is pushed upward against elastic force of the elastic member 60, pushing out the transfer head 30 from the opening 56 of the cover member 55. Then the transfer head 30, pressed against the receiving surface 71, can be moved parallel to the receiving surface 71 to transfer the coating film continuously. As in the case of spotting transfer, the pawl member 52 which moves with the sliding body 50 is in a forward direction, and hence not in engagement, with the gear 40. Therefore, the transfer tape T is unreeled as the transfer head 30 moves on the receiving surface, transferring the coating film continuously onto the receiving surface 71. When the transfer tool is released from pressing, the pawl member 52, in engagement with the gear 40, rotates the supply reel 21*a* by predefined degrees as it is moved forward, thereby supplying a predefined length of the unused transfer tape T.

The embodiment presents but one example of the forms of the casing main body 20, the sliding body 50, and the stopper 23, and of the arrangements of the supply reel 21*a* and take-up reel 21*b*, and therefore various modifications are possible.

Further, while the gear 40 is provided coaxially on the supply reel 21*a* in this embodiment, it can be arranged coaxially on the take-up reel 21*b* to achieve the same effect.

Furthermore, although a pressure-sensitive adhesive film was employed as a coating film in the embodiment, it can be a film for correction or a colored film for decoration.

INDUSTRIAL APPLICABILITY

The coating film transfer tool of the present invention can be used to unfailingly transfer the coating film on a spot with the cover member of the sliding body in a closed position. When it is in an open position, on the other hand, the coating film transfer tool can be used in a usual manner to transfer the coating film over a wide range on the receiving surface. Thus, the present invention enabled switchover between spotting transfer by pressing and continuous transfer by pressing and parallel shifting with a simple operation of opening and closing the cover member of the sliding body, which remarkably improved handleability of the coating film transfer tool.

What is claimed is:

1. A coating film transfer tool comprising a supply reel which supplies a transfer tape composed of a base tape and a coating film attached thereon, a transfer head which is pressed against a receiving surface to transfer said coating film thereon, a take-up reel which rolls up the base tape after transfer, and a cooperative drive mechanism which is adapted to cause said reels to rotate cooperatively, all of which are encased in a casing main body, characterized in that:

a gear is coaxially provided on said supply reel or take-up reel;

the tool includes a sliding body which comprises a pawl member which engages with said gear when moving in one direction relative to said gear to rotate said gear and said reels in a direction to feed transfer tape from the supply reel, and over the transfer head to the take-up reel, and which moves without rotating said gear in a direction opposite to said one direction, said sliding body also comprising a cover member which houses said transfer head and has an opening through which the transfer head can protrude, said sliding body being movable within the casing main body in a direction such that the transfer head can protrude through said opening and retract to a protected position within the cover member, and an elastic member within said casing main body elastically urging the sliding body in a direction to cause said pawl member to rotate the gear and said transfer head to protrude through said opening;

said cover member is able to open and close on said sliding body;

with said cover member in a closed position, said coating film can be transferred on a spot by pressing said cover member against the receiving surface to cause said sliding body to retreat and by pressing said transfer head pushed out of the opening of said cover member against the receiving surface, and as said cover member is released from pressing and said sliding body is moved forward, said supply reel and said take-up reel can be rotated by said pawl member in a forwarding direction of said transfer tape; and with said cover member in an open position, said coating film can be transferred continuously by pressing said transfer head against and moving it parallel to the receiving surface.

2. A tool according to claim 1, wherein said casing main body includes a stopper to lock said cover member in an open position.

* * * * *